US005310304A

United States Patent [19]

Baumgartner

[11] Patent Number: 5,310,304

[45] Date of Patent: May 10, 1994

[54] LOAD-LIFTING DEVICE

[75] Inventor: Guido Baumgartner, Root, Switzerland

[73] Assignee: Heppenstall Holding AG, Cham, Switzerland

[21] Appl. No.: 930,705

[22] PCT Filed: Dec. 16, 1991

[86] PCT No.: PCT/CH91/00269

§ 371 Date: Sep. 30, 1992

§ 102(e) Date: Sep. 30, 1992

[87] PCT Pub. No.: WO92/13792

PCT Pub. Date: Aug. 20, 1992

[30] Foreign Application Priority Data

Feb. 8, 1991 [CH] Switzerland ..... 396/91

[51] Int. Cl.[5] ..... B66C 1/04; B66C 1/28

[52] U.S. Cl. ..... 414/606; 294/2; 294/65.5; 294/81.52; 414/626; 414/669; 414/672

[58] Field of Search ..... 414/606, 626, 672, 618, 414/669, 564; 294/2, 81.52, 65.5

[56] References Cited

U.S. PATENT DOCUMENTS

| | | | |
|---|---|---|---|
| 762,759 | 6/1904 | Reuter | 414/606 |
| 1,564,655 | 12/1925 | Westbo | 294/81.52 |
| 1,833,545 | 11/1931 | Wehr | 294/81.52 |
| 1,957,719 | 5/1934 | Naugle et al. | 414/606 |
| 3,558,178 | 1/1971 | Taylor | 294/81.52 |
| 3,606,056 | 9/1971 | Morgan | 294/81.52 X |
| 4,975,018 | 12/1990 | Langenbacher et al. | 294/81.52 |

FOREIGN PATENT DOCUMENTS

| | | | |
|---|---|---|---|
| 1146993 | 5/1983 | Canada | 294/81.52 |
| 174642 | 9/1906 | Fed. Rep. of Germany . | |
| 290886 | 3/1916 | Fed. Rep. of Germany . | |
| 1289640 | 2/1969 | Fed. Rep. of Germany . | |
| 2426359 | 12/1975 | Fed. Rep. of Germany . | |
| 3112348 | 10/1982 | Fed. Rep. of Germany . | |
| 1287442 | 2/1962 | France | 414/626 |
| 131480 | 5/1960 | U.S.S.R. | 294/65.5 |

*Primary Examiner*—David A. Bucci
*Attorney, Agent, or Firm*—Feiereisen & Kueffner

[57] ABSTRACT

A load-lifting device includes a load carrying beam at whose underside are arranged load-lifting magnets and which has on both sides vertical support columns, wherein securing arms of a load securing device are arranged on the vertical support columns so as to be swingable and in out about a vertical axis. The securing arms engage underneath a suspended load when oriented toward each other in a secured position. The support columns are each arranged on upper support arms which are swingably fastened to a lifting device. The lifting device is supported by the load carrying beam. The securing arms engage in the secured position thereof underneath a suspended load and can be placed against the underside of the load.

9 Claims, 3 Drawing Sheets

LOAD-LIFTING DEVICE

TECHNICAL FIELD

The invention relates to a load-lifting device. The load lifting device includes a load-carrying beam at whose underside are arranged load-lifting magnets and which has on both sides vertical support columns, wherein securing arms of a load-securing device are arranged on the vertical support columns so as to be swingable in and out about a vertical axis each, and wherein the securing arms engage underneath a suspended load when oriented toward each other in a secured position.

PRIOR ART

Load-lifting devices of the above-mentioned type are known, for example, from German Patent 17 46 42. In a type of such load-lifting devices, the load securing devices consist of stirrups which can be swung transversely of the axis of the load-carrying beam from a position of rest in which the securing arms are located above the load-carrying beam into the secured position in which the securing arms ar located underneath the suspended load. It is a disadvantage in this device that, on the one hand, the swinging path of the load-securing arms from the upper into the lower position requires a very large lateral free space. On the other hand, the securing arms are effective only at a certain distance from the load-lifting magnet, so that a free space may exist between the load and the securing arm, so that the load may drop onto the securing arm when the magnet force fails, which may lead to damage of the securing arm and the securing device. In another embodiment of the load-lifting device, the above disadvantages are partially eliminated by the fact that securing arms can be swung in and out about a vertical axis extending transversely of the load-carrying beam from a free position parallel to the load carrying beam into a secured position transversely of the load carrying beam. Also in this case, the securing arms have the above-mentioned disadvantageous free distance from the suspended load.

DE 31 12 348 A1 describes a load-lifting device which has a load carrying beam with two load-lifting magnets and a load-securing device. The latter includes two rigid safety stirrups which each have an upper essentially horizontal girder to whose ends are integrally connected vertically downwardly extending webs which, in turn, have short securing arms which engage under a suspended load in the secured position. The safety stirrups are swingably fastened to a lifting device. This load-securing device has a number of decisive disadvantages. Because of the rigid configuration of the safety stirrups, the latter require a relatively large free space when being swung to the side; in order to limit the latter, the securing arms can only be short, so that they cannot engage under the suspended load over the entire width. Therefore, the load-lifting device is only suitable for individual slabs, but not for receiving bundled goods which would fall through between the securing arms when the load-lifting magnets fail. The rigid configuration of the safety stirrups restricts the use of the load-lifting device to very narrowly defined dimensions of the slabs. This is reinforced by the requirement that the safety stirrup must in the secured position rest with its upper horizontal girder on the load-carrying beam. Consequently, there is neither an adjustment of the rigid safety stirrup to different load dimensions, nor do the securing arms rest against the load, so that there remains a free gap between load and securing arm with the attendant above-mentioned disadvantages.

DISCLOSURE OF THE INVENTION

It is the object of the invention to construct a load-lifting device of the above-mentioned type in such a way that the load-securing device requires a minimum of lateral free space, and that it is ensured that the suspended load is secured in an optimum manner while still permitting a relatively light-weight construction.

In accordance with the present invention, the support columns are each arranged on upper support arms which are swingably fastened to a lifting device, wherein the lifting device is supported by the load-carrying beam, the entire arrangement being such that the securing arms in the secured position are oriented toward each other and engage underneath a suspended load and can be placed against the underside of the load.

The fact that the securing arms are fastened on support columns which are driven so as to be vertically raisable and lowerable results in a optimum vertical force application for a load to be secured, so that the load securing device can be of relatively light construction. Nevertheless, it is ensured that the suspended load is securely supported because the securing arms can also be moved against the suspended load and, thus, no play exists between the suspended load and the securing arms. Moreover, the load-securing device requires only a small lateral free space next to the load-carrying beam because the securing arms can be swung about the axis of the support columns from the free position parallel to the load carrying beam into the secured position transversely of the load carrying beam. The fact that the support arms are arranged on the lifting device so as to be swingable provides the result that the support arms ensure in the swung-out state a greater free space for receiving a suspended load. When the support arms are swung in, the support columns make lateral contact with the suspended load, so that also a lateral play between the suspended load and the support column is avoided, whereby the securing effect is further improved.

Various possibilities exist for constructing the lifting device. For example, the lifting device may be a screw spindle or a rack. In accordance with an advantageous feature, the lifting device includes a telescoping column which is preferably drivable by means of a hydraulic piston/cylinder unit.

In accordance with another development of the present invention, the support columns are rotatably arranged on the support arms, wherein each support column has a cantilever which is connected through a coupling rod to the lifting device in such a way that, when the support columns are swung in toward the load-carrying beam, the securing arms are swung from a free position parallel to the load carrying beam into the secured position transversely underneath the load carrying beam. particularly simple and secure development of the load-lifting device because swinging of the securing arms in and out is effected simultaneously with the in and out swinging of the support arms and, thus, the support columns, so that no additional drive is required for this purpose. It is further advantageous to guide the support columns in guide arms which can be swung in and out and which are preferably connected in an articulated manner to the frame of the lifting device, so that the stability of the load-securing device is improved.

Various drive possibilities are conceivable for swinging the support columns in and out. However, it is particularly advantageous if the load securing device has a central drive, preferably a piston/cylinder unit, which acts on the guide arms through coupling rods.

The load-lifting device may only have one load-securing device. However, it is advantageous to arrange two load-securing devices on the load-carrying beam. A particularly simple configuration and synchronization of the drive of the load-securing devices results from if one of the load securing devices has a drive and the additional load securing device is coupled so as to be driven by the first load securing device, wherein preferably adjacent guide arms are connected to each other by means of a coupling rod.

BRIEF DESCRIPTION OF THE DRAWING

In the following, an embodiment of the load-lifting device according to the invention will be described with the aid of the drawing. In the Drawing.

MODE FOR CARRYING OUT THE INVENTION

Figure 1:
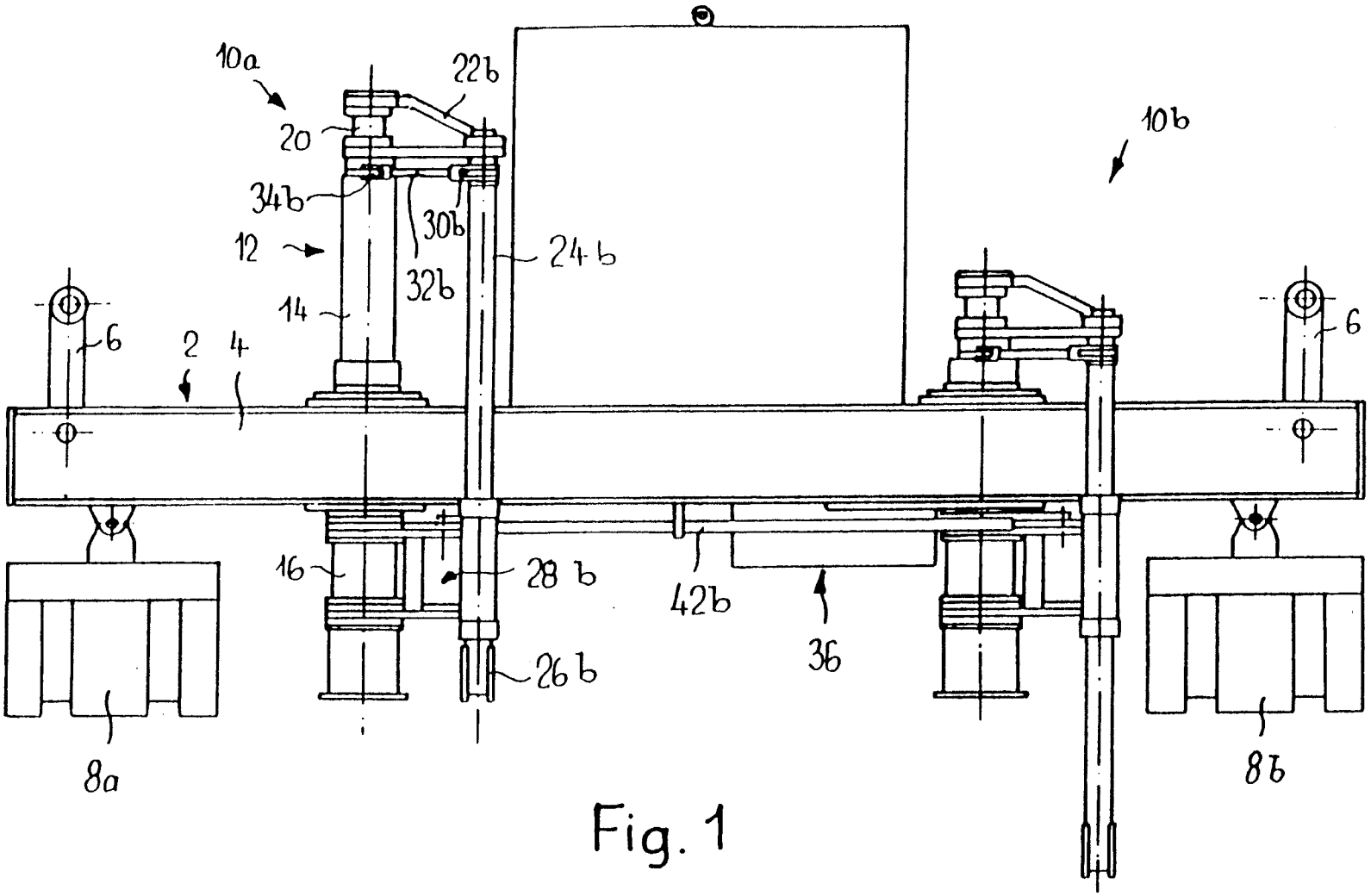
FIG. 1 is a side view of a load-lifting device with two load-lifting magnets and two load-securing devices.
Figure 2:
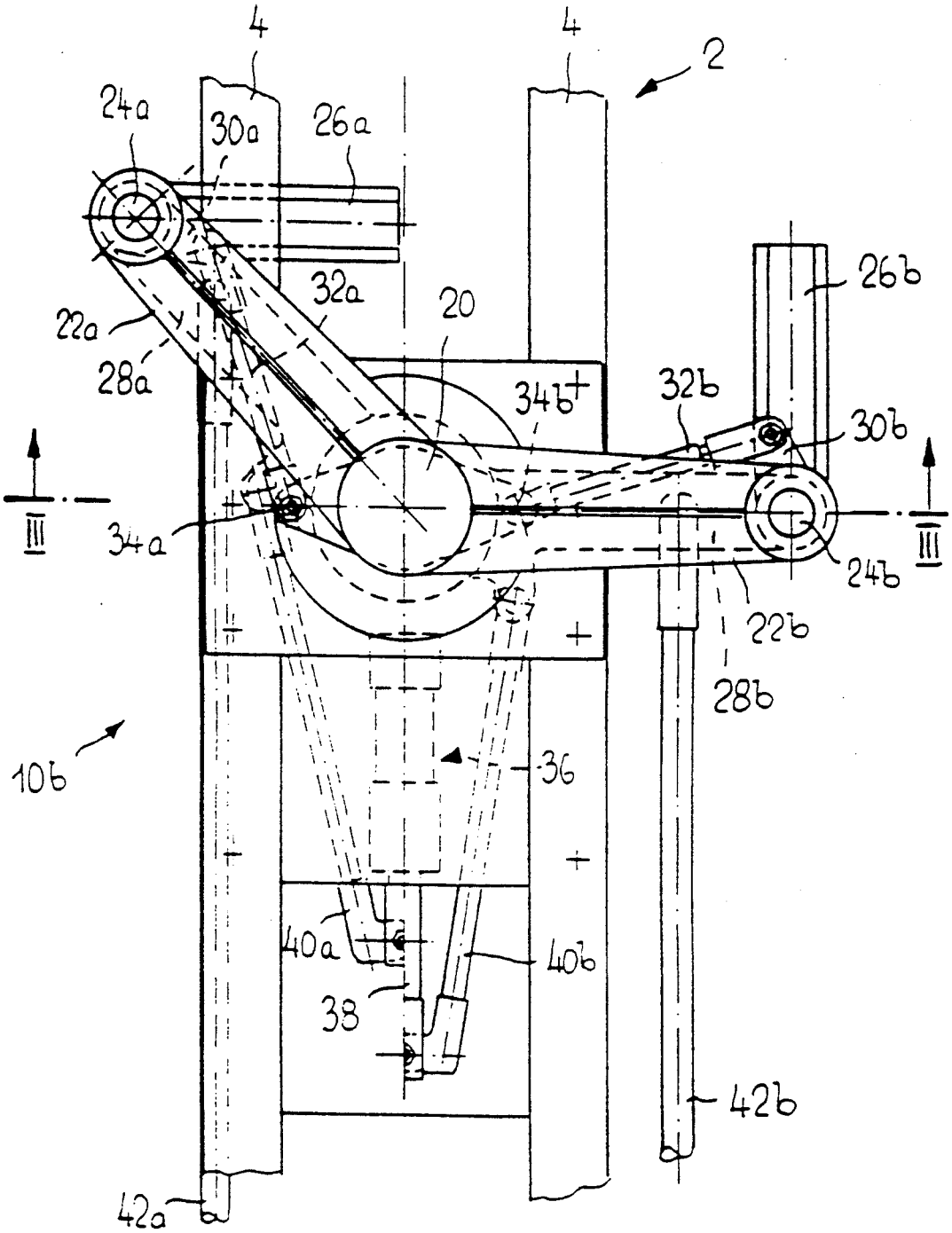
FIG. 2 is a plan view of a load-securing device of FIG. 1, wherein the left-hand side of the figure shows the components of the load lifting device in the secured position and the right hand side of the figure shows the components of the load lifting device in the free position.

As can be seen particularly in FIG. 1, the load-lifting device includes a load-carrying beam 2 which is formed by two C-shaped girders 4 which are connected to each other. Two articulated lugs 6 for suspending the load-carrying beam from a carrying rope are arranged on the load-carrying beam 2. Two load-lifting magnets 8*a*, 8*b* are attached to the underside of the load-carrying beam 2 in an articulated manner. In addition, the load-carrying beam 2 is equipped with two load-securing devices 10.

Figure 3:
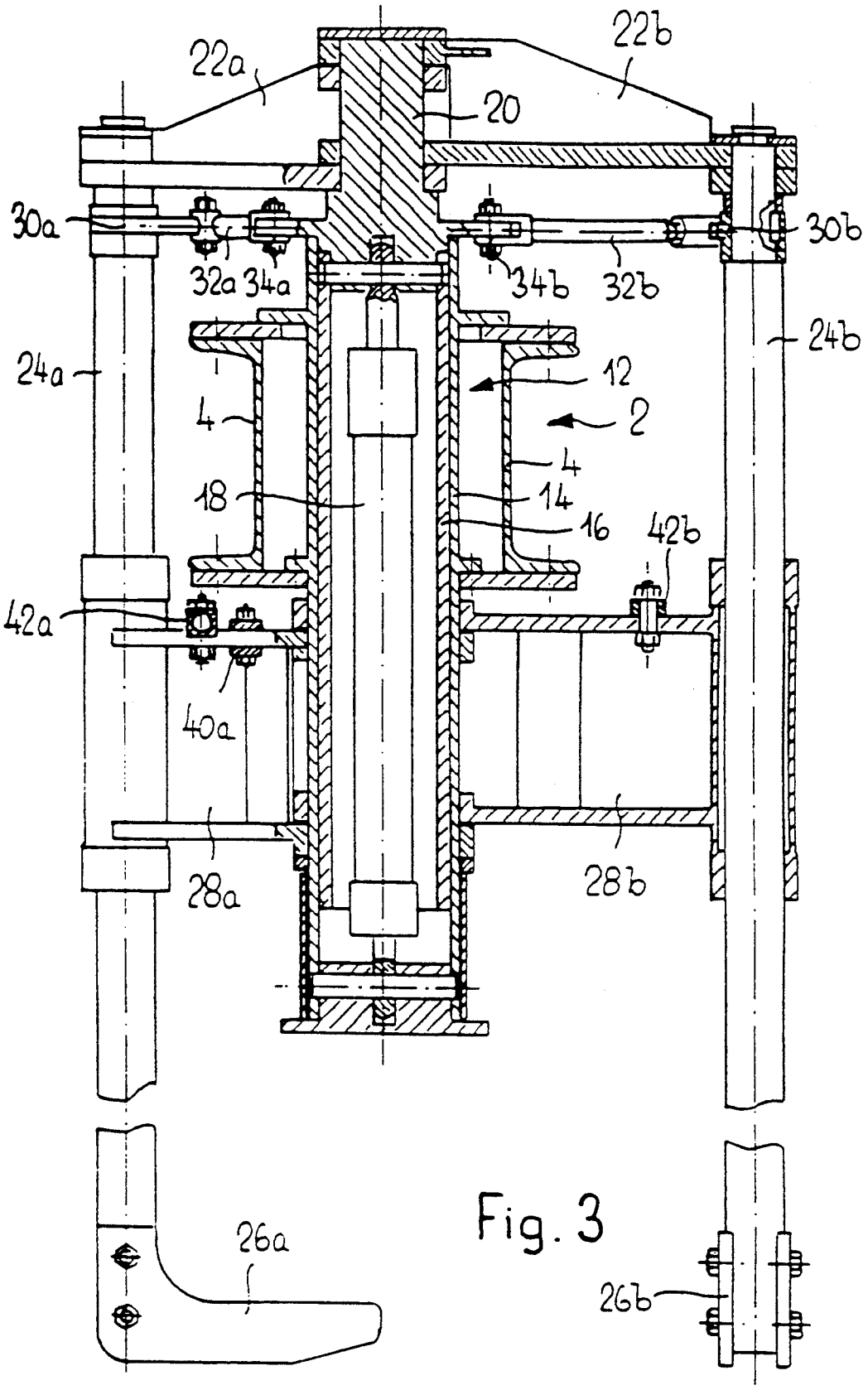
FIG. 3 is a sectional view of the load-securing device of FIG. 2, wherein the left-hand side of the figure shows the components of the load lifting device in the secured position and the right hand side of the figure shows the components of the load lifting device in the free position taken along sectional line III—III of FIG. 2.

The load-securing devices 10 include a lifting device 12 which is fastened to the girders 4. The lifting device 12 is formed of telescoping tubes 14, 16, wherein the outer tube 14 is fastened to the girders 4. A hydraulic piston/cylinder unit 18 for driving the lifting device is arranged within the inner tube 16. The inner tube 16 has at the upper end a cylindrical head 20. Two support arms 22*a*, 22*b* are swingably arranged on the head 20. The support arms 22*a*, 22*b* have at their outer ends also rotatably arranged support columns 24*a*, 24*b*. Securing arms 26*a*, 26*b* are fastened to the lower ends of the support columns 24*a*, 24*b*. In addition, the support columns 24*a*, 24*b* are guided on guide arms 28*a*, 28*b* which are swingably attached in an articulated manner to the frame, i.e. to the outer tube 14 of the lifting device 12. Each support column 24*a*, 24*b* is provided near the support arm 22*a*, 22*b* with a cantilever 30*a*, 30*b*. Coupling rods 32*a*, 32*b* which are fastened at appropriate joints 34*a*, 34*b* to the head 20 of the lifting device are connected in an articulated manner to the cantilevers 30*a*, 30*b*. The joints 34*a*, 34*b* are rigidly connected to the head 20. The arrangement is such that, when the support arms 22*a*, 22*b* and guide arms 28*a*, 28*b* are swung in, the securing arms 26*a*, 26*b* extend perpendicularly to the vertical plane of the load-carrying beam, i.e. the securing arms 26*a*, 26*b* assume the secured position, as it is illustrated on the left-hand side of FIG. 3. When the support arms 22*a*, 22*b* or the guide arms 28*a*, 28*b* are swung out, the coupling connection ensures that the securing arms 26*a*, 26*b* are oriented parallel to the vertical plane of the load-carrying beam, as it is illustrated in the right-hand side of FIG. 3.

A central drive 36 in the form of a piston/cylinder unit which is also arranged on the frame, i.e., on the outer tube 14 of the lifting device 12 and extends parallel to the load-carrying beam 20 is used for swinging in and out the support arms 22*a*, 22*b* and the guide arms 28*a*, 28*b*. Two coupling rods 40*a*, 40*b* are attached in an articulated manner to the piston rod 38 of the piston/-cylinder unit 36. The two coupling rods 40*a*, 40*b* are connected in an articulated manner to the guide arms 28*a*, 28*b*. Only one load-securing device 10 is provided with this drive 36, wherein the other load-securing device 10 is driven by being connected to the first load-securing device 10 through coupling rods 42*a*, 42*b*. The coupling rods connect to each other the respective guide arms 28*a*, 28*b* of the load-securing devices 10.

As is clearly apparent from the drawings, the device operates as follows. For receiving a load on the load-lifting magnets 8*a*, 8*b*, the load-securing devices 10 are in the free position illustrated on the right-hand side of FIG. 3, i.e. the lifting device 12 is lowered, the support arms 22*a*, 22*b* and the guide arms 28*a*, 28*b* are swung out and the securing arms 26*a*, 26*b* extend parallel to the load-carrying beam 2. As soon as a load is suspended from the load-lifting magnets 8*a*, 8*b*, the load-securing devices 10 are swung by means of the drive 36 into the secured position illustrated on the left-hand side of FIG. 3. This is achieved by the piston/cylinder unit 36 which swings the guide arms 28*a*, 28*b* against the load-carrying beam 2, wherein the coupling rods 32*a*, 32*b* simultaneously swing the support columns 24*a*, 24*b* and, thus, align the securing arms 26*a*, 26*b* transversely of the vertical plane of the load-carrying beam 2. Subsequently, the piston/cylinder unit 18 of the load-lifting device 12 is actuated and the securing arms 26*a*, 26*b* are raised until they rest against the load suspended from the load-lifting magnets 8*a*, 8*b*. The disengagement of the suspended load takes place in the reverse sequence of the above-described sequence of movement of the load-securing devices 10.

I claim:

1. A load-lifting device comprising a load-carrying beam and at least one load-lifting magnet having two sides, the at least one load-lifting magnet being connected to the load carrying beam, at least one load-securing device comprising a vertical support column on each side of the load-lifting magnet, a drive for swinging the vertical support columns, a securing arm attached to each vertical support column, the securing arms being movable by swinging the vertical support columns between a free position in which the securing arms extend parallel to a load suspended from the load-lifting magnet and a secured position in which the securing arms are aligned with each other and completely engage under the load, guide arms for guiding the swingable support columns, the guide arms being mounted so as to be swingable, support arms fastened to upper ends of the support columns, further comprising a lifting device mounted on the load carrying beam for raising and lowering the securing arms and placing the aligned securing arms in the secured position against an underside of the load.

2. The load-lifting device according to claim 1, wherein the lifting device comprises a telescoping column.

3. The load-lifting device according to claim 2, comprising a hydraulic piston/cylinder unit for driving the telescoping column.

4. The load-lifting device according to claim 1, wherein the support columns are rotatably arranged on the support arms, and wherein each support column has a cantilever which is connected through a coupling rod to the lifting device.

5. The load-lifting device according to claim 1, wherein the lifting device comprises a frame, the guide arms being connected to the frame in an articulated manner.

6. The load-lifting device according to claim 5, wherein the drive of the load securing device is connected to the guide arms through coupling rods.

7. The load-lifting device according to claim 6, wherein the drive is a piston/cylinder unit.

8. The load-lifting device according to claim 1, comprising at least two load securing devices.

9. The load-lifting device according to claim 8, wherein a first of the two load securing devices includes the drive for swinging the vertical support column, further comprising connecting rods for coupling the guide arms of the first and of a second of the two load securing devices to each other on the two sides of the load lifting magnet.

* * * * *